United States Patent [19]

Webster et al.

[11] 4,187,820

[45] Feb. 12, 1980

[54] INTAKE MANIFOLD VARIABLE ATOMIZING VALVE

[76] Inventors: Sherwood F. Webster, 7832 Via Marina, Scottsdale, Ariz. 85258; Richard L. Heise, 133 E. Garfield, Tempe, Ariz. 85281

[21] Appl. No.: 950,470

[22] Filed: Oct. 11, 1978

[51] Int. Cl.[2] ..... F02M 29/04

[52] U.S. Cl. ..... 123/141; 261/65; 261/78 R; 48/180 P

[58] Field of Search ..... 123/141; 261/78 R, 65; 48/180 P, 180 B

[56] References Cited

U.S. PATENT DOCUMENTS

| | | | |
|---|---|---|---|
| 1,244,379 | 10/1917 | Short | 123/141 |
| 2,027,480 | 1/1936 | Higley | 123/141 |
| 2,051,556 | 8/1936 | Higley | 123/141 |
| 3,945,361 | 3/1976 | Pitrowicz | 123/141 |
| 4,044,077 | 8/1977 | Gupta | 123/141 |
| 4,058,102 | 11/1977 | Fabritz | 123/141 |
| 4,099,503 | 7/1978 | Casey | 123/141 |

*Primary Examiner*—Ira S. Lazarus
*Attorney, Agent, or Firm*—B. P. Fishburne, Jr.

[57] ABSTRACT

An air-fuel mixture in the proper ratio is delivered by a carburetor to a variable atomizing valve which is positioned inside of the intake manifold by projecting through the main inlet opening on the customary carburetor base mounting face of the intake manifold. The atomizing valve is normally biased by an eccentric spring means to a nearly closed position but opens automatically to any required position in response to engine demand. The valve embodies an interior relatively stationary imperforate barrier sleeve and an exterior relatively movable screen assembly mounted telescopically on the barrier sleeve. The screen assembly consists of an interior comparatively coarse mesh screen surrounded by a fine mesh screen and an exterior rigid cage for the screens. The two concentric screens are in firm contact around their entire circumferences. A bearing intervened with the barrier sleeve and the rigid cage establishes a necessary jump space between the interior screen and the bore of the barrier sleeve so that the incoming fuel charge after turning will impinge with some force on the interior screen. Complete atomization of the engine fuel charge is obtained with many attendant advantages and wetting of the intake manifold with raw fuel droplets is completely avoided. The incoming fuel charge is aimed at the intake ports of the engine, is a cool charge, and travels with velocity.

12 Claims, 9 Drawing Figures

FIG. 1
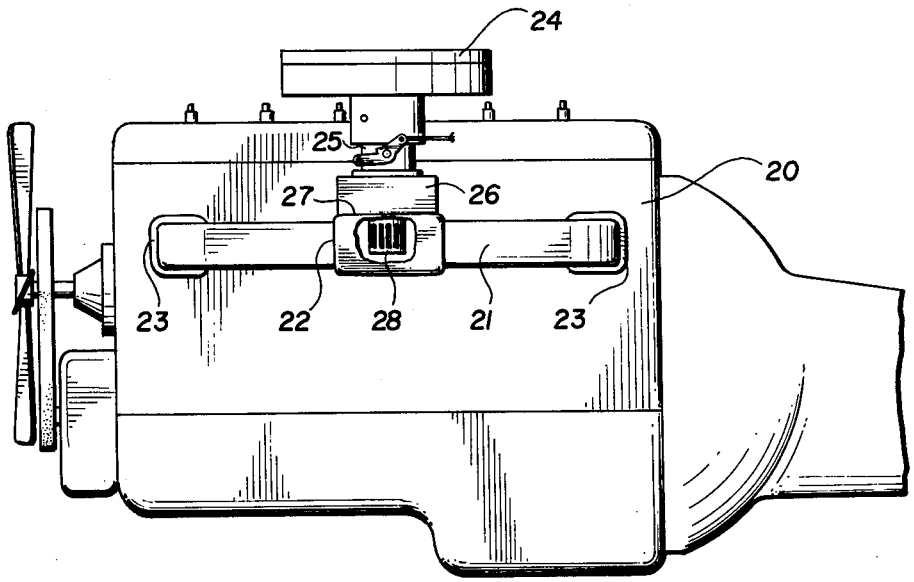
FIG. 2
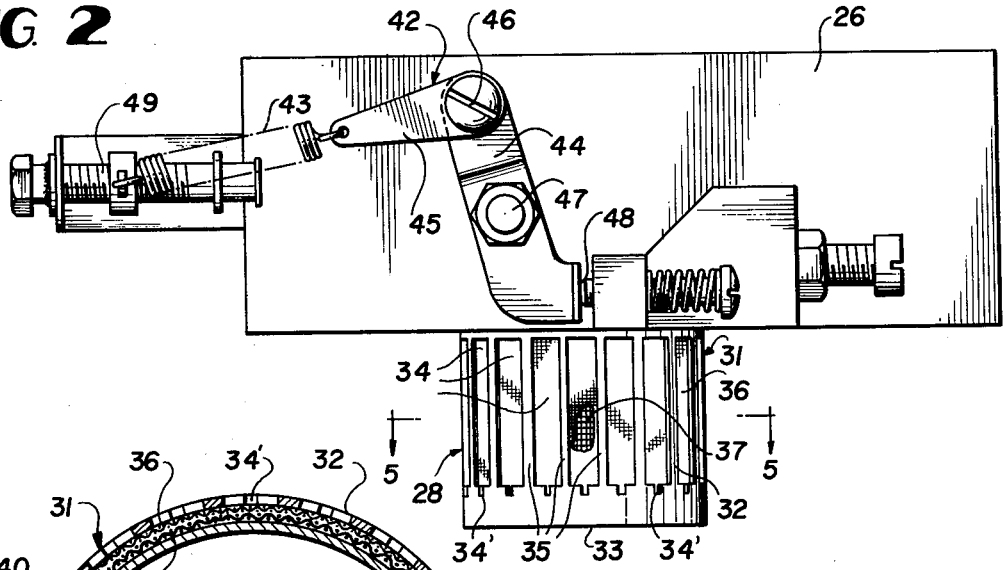
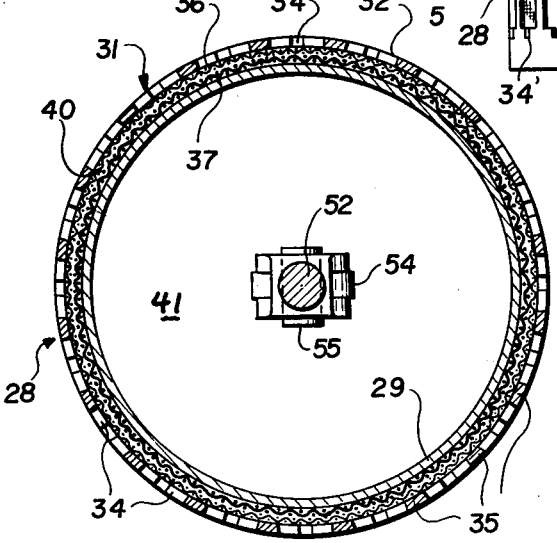
FIG. 5

INTAKE MANIFOLD VARIABLE ATOMIZING VALVE

CROSS-REFERENCE TO RELATED APPLICATION

This application contains subject matter in common with prior copending application Ser. No. 906,070, filed May 15, 1978, for AN ATOMIZING DEVICE.

BACKGROUND OF THE INVENTION

The current worldwide energy crisis and the drive to clean up the environment, particularly the atmosphere, has created an urgent need for internal combustion engines having greatly increased fuel efficiency and much cleaner exhaust emissions. Responsive to this need, the automotive industry worldwide has taken action on a panic basis, and as a result of this action some improvements in both above categories have been realized, but only with a considerable sacrifice in engine performance, as is well known to any driver of a present day automobile. Engine starting is difficult and engine performance prior to complete warm-up is extremely poor. Such poor performance is in part due to costly anti-pollution equipment now required on all automotive vehicles and to other design changes which have been made in haste in an effort to meet the pressing requirement of fuel economy and reduced air pollution. In fact, some of the recent efforts of the automotive industry have proven to be self-defeating and it is believed that hasty efforts to find solutions to problems may have taken the industry along some improper paths which are now very difficult to deviate from without great economic loss.

One particular area of development which has been somewhat neglected is that relating to the delivery of the fuel charge to the combustion chambers of piston engines in the most beneficial manner in terms of fuel economy, cleaner emissions and better overall engine performance. Computerized fuel injection systems have been devised, but such systems are extremely costly and are economically feasible only on the most expensive vehicles. Furthermore, while fuel injection possesses a number of known advantages over engines which utilize carburetors, there are also known disadvantages incident to fuel injection.

Carburetors are very satisfactory in establishing a proper ratio of air and fuel in an engine fuel charge but are quite poor in properly mixing and atomizing the fuel. As a result, in carburetor fed engines much raw gasoline in the form of droplets enters the intake manifold and actually wets the manifold and is not atomized or mixed with air for proper combustion and is ultimately exhausted into the atmosphere as a harmful pollutant without utilization of its contained energy.

It is the principal objective of this invention to deal successfully and as completely as possible with all of the above defects of the prior art in a very simplified and comparatively economical manner. By means of the invention, a very significant improvement in fuel economy can be achieved, as much as 25%, with a comparable lessening of atmospheric pollutants in the engine exhaust. At the same time, greatly improved engine performance in all stages of operation is achieved, including cold starting, idling, low speed and high speed response, and most notably improved performance in the critical warm-up period which is highly unsatisfactory in present-day automobiles. With the invention, the most beneficial characteristics of carburetion and fuel injection are retained, while the most unsatisfactory characteristics of both systems are avoided.

The prior art contains some teachings pertaining to the utilization of screens to accomplish the atomization of fuel which is being inducted into the combustion chambers of engines. Apparently, the potential benefits which can be derived from screen atomization have been misunderstood and/or overlooked in the prior art, with the result that this method of atomization has not been adequately investigated or advanced in the art and some early efforts which proved unsuccessful have apparently been abandoned.

To comply with the requirements of 37 C.F.R. 1.56 relative to disclosure of known prior art teachings, the following U.S. Pat. Nos. are made of record herein: 1,173,157 2,701,557 4,058,102 4,088,104 4,091,786 4,092,966.

SUMMARY OF THE INVENTION

An engine demand responsive variable atomizing valve is carried by a supporting module which is mounted between the base of a conventional down draft carburetor and the top carburetor mounting pad of an engine intake manifold. The atomizing valve is cylindrical and projects through the main fuel charge inlet bore of the manifold which normally registers with a bore in the carburetor base containing the main throttle valve. The atomizing valve assembly of the invention is thus positioned inside of the manifold centrally in relation to the manifold branches which deliver the fuel charge to the engine cylinders. The incoming fuel charge in passing through the atomizing valve is aimed at the combustion chamber intake ports.

The atomizing valve includes an interior relatively stationary cylindrical imperforate barrier sleeve, curtain or fuel charge blocking element, and an exterior axially reciprocal atomizing screen assembly telescopically engaging over the barrier sleeve. The barrier sleeve is anchored to the supporting module intervened with the carburetor base and manifold mounting pad. The screen assembly consists of an interior relatively coarse mesh screen surrounded by an exterior fine mesh screen, the two screens having their cylindrical walls in intimate contact entirely around the circumference of the screen assembly. A rigid cage for the atomizing screens is provided and this cage contains slotted areas and intervening bars to expose a plurality of areas through which the incoming fuel mixture is atomized. A bearing or bushing in the bore of the rigid cage slidably engages the exterior of the barrier sleeve and establishes a necessary fuel charge radial jump space between the bore of the sleeve and the surface of the interior screen. The fuel charge can gain momentum and velocity in this space before striking the screens.

The screen assembly is spring-biased toward a retracted position on the barrier sleeve which corresponds to engine idle. The screen assembly of the atomizing valve extends or opens automatically against spring tension in response to fuel charge velocity, which results from the demand of the engine cylinders for fuel. The automatic incremental adjustability of the atomizing valve responsive to engine demand is infinite. A spring-biasing linkage connected with the reciprocal screen assembly is of the overdead-center type so that the spring may offer greater resistance to valve opening at certain times, such as during engine idle and initial acceleration, than at other times, as during high speed cruise when spring resistance is automatically reduced. A vacuum assisted linkage is also provided to assure complete or nearly complete closing of the atomizing valve during deceleration when manifold vacuum is at the maximum.

Paramount among the many advantages derived from the invention are the following:

(1) Complete atomization of the fuel charge at all times during engine operation with a resulting delivery of a completely uniform charge to every engine cylinder.

(2) A constant high velocity fuel charge aimed at the engine combustion chambers under all conditions of engine demand for fuel, including idle, low speed and high speed engine operation.

(3) Increased volumetric efficiency resulting in greater power and increased mileage and consistently smoother engine operation without stalling, due to maintaining ambient air temperature adjacent to the atomizing valve in the intake manifold instead of an elevated temperature in the range of 200° F. to 600° F. which is standard in present-day automotive engines.

(4) Equal distribution of fuel charge to all cylinders as a result of complete atomization, higher velocity and circular configuration of atomizing valve in intake manifold, and the complete absence of liquid fuel droplets in the manifold.

(5) Higher velocity of ambient temperature air-fuel mixture as it enters the intake manifold, as a result of harnessing a previously overlooked inherently present energy source which is the increased velocity of fluids passing through restricted passages. No outside energy input is required for this benefit, merely the utilization of a naturally present source of energy. This results in greater fuel economy, more power and reduced pollution.

Additional benefits flowing from the invention include reduction of the cold start problem and engine stalling because, with the invention, it is impossible for the operator to pump raw gas into the intake manifold. Dieseling,also called engine run-on, is substantially eliminated by use of an ambient temperature fuel charge and complete atomization of the charge.

Present-day use of a heated charge in the intake manifold contributes to dieseling and engine knock. Because of the invention, the engine can operate efficiently on fuel having a significantly lower octane rating. Another very important benefit derived from lower temperature of the fuel charge is the reduction or elimination of lethal nitric oxide ($NO_x$) in the exhaust emission. The exhaust will contain more carbon dioxide and water than under standard practice. Carbon monoxide (CO) and unburned hydrocarbons are also substantially reduced in the exhaust emissions.

BRIEF DESCRIPTION OF THE DRAWINGS

FIG. 1 is a side elevation of an engine and intake manifold equipped with the automatic variable atomizing valve according to the invention.

FIG. 2 is an enlarged side elevation of the atomizing valve and its support element and associated valve biasing means.

FIG. 5 is a horizontal section taken through the atomizing valve on line 5—5 of FIG. 2.

DETAILED DESCRIPTION

Figure 3:
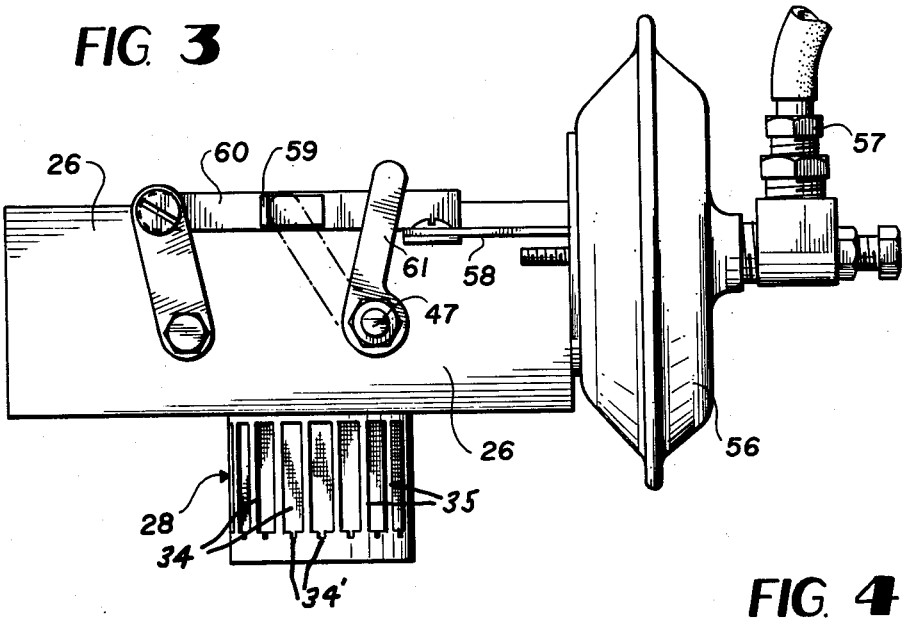
FIG. 3 is a similar view showing the opposite side of the valve and support element and associated vacuum boosted linkage for closing the atomizing valve substantially completely during engine deceleration.

Referring to the drawings in detail wherein like numerals designate like parts throughout the same, and referring first to FIG. 1, an engine 20, such as a conventional six cylinder automotive engine, has an intake manifold 21 for supplying a suitable air-fuel mixture to the engine cylinders in three pairs through center and opposite end manifold outlet branches 22 and 23. While a six cylinder in-line engine has been illustrated, it should be stated that the invention is applicable to all engine types. The customary air cleaner 24 and down draft carburetor 25 are shown in FIG. 1 and a mounting module or element 26 forming part of the invention is placed between the carburetor base and a top machined pad 27 on the manifold 21 on which the carburetor is usually mounted. An automatic variable atomizing valve carried by the mounting element 26 is also shown at 28 in FIG. 1.

Referring to the other drawing figures, the automatic atomizing valve 28, which is the main subject matter of the invention, comprises a stationary cylinder sleeve 29 which is fixedly secured in a bore 30 of the element 26 so as to be coaxial with the throat of the carburetor 25 and perpendicular to the longitudinal axis of the manifold 21. The sleeve 29 is an imperforate sleeve and projects well into the interior of the intake manifold below the top mounting pad 27 thereof. The sleeve 29 has a dual purpose in the invention in that it serves as a guide for a surrounding axially movable screen assembly 31 of the atomizing valve 28 and as a curtain or barrier element which regulates the degree of exposure of screen in the assembly 31 and therefore the degree of opening of the valve during engine operation.

Figure 7:
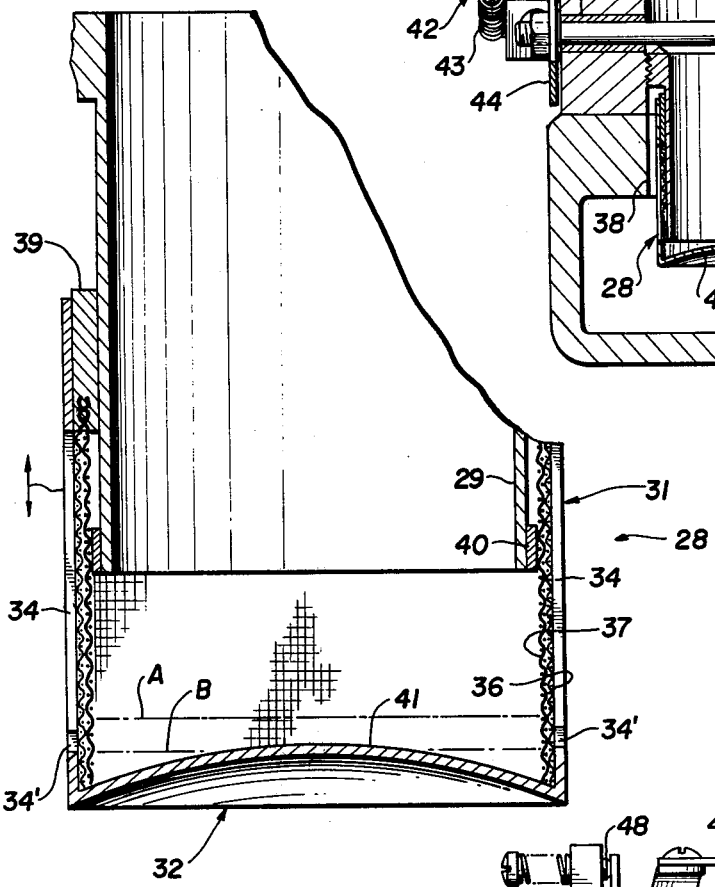
FIG. 7 is an enlarged fragmentary vertical section taken through the movable screen assembly and associated stationary sleeve and showing various operational relative positions of these elements.

The axially moving screen assembly 31 comprises an outer cylindrical cup-like rigid cage 32 having a closed bottom wall 41 and a plurality of circumferentially equidistantly spaced longitudinal slots 34 intervened by parallel longitudinal bars 35 which prevent the screen elements inside of the cage 32 from being drawn by suction into the intake manifold. Within the rigid cage 32 is a pair of concentric cylindrical equal length screens 36 and 37, with the outermost screen 36 lying firmly against the interiors of the bars 35. The two screens extend axially from the bottom wall 41 to a point above the tops of the slots 34 so that the two screens completely cover the slots 34. As best shown in FIG. 7, the top end portions of the two screens are suitable anchored to an upper sleeve bearing 39 of the cage 32, which bearing will be further discussed. The total area of screen exposed through the several slots 34 is at least equal to the area of a main inlet opening 38 in the top of intake manifold 21, within which the atomizing valve is located. Preferably, the total area of screen exposed through the slots 34 is greater than the area of the opening 38.

The exterior screen 36 is a stainless steel fine mesh screen in the range of 100–250 mesh and preferably 120 mesh. The exterior screen 36 has its cylindrical wall in tight contact with the several bars 35 of rigid cage 32. The interior screen 37 is of a coarser mesh in the range of 30–60 mesh and preferably is a 45 mesh stainless steel screen. The cylindrical wall of the interior screen is packed tightly against the exterior screen 36 with no spacing between the two screens. It has been found by experimentation that any other screen arrangement will not accomplish the desired function of complete atomization of the fuel mixture. If the coarser screen is arranged outermost in the assembly, the desired result is not produced nor is it produced if there is a space between the two screens or if a single screen only is employed in the cage 32, or if three or more concentric screens are employed. The described arrangement of the two screens 36 and 37 is quite critical in achieving the desired complete atomization of the fuel charge, and the complete elimination of raw liquid fuel droplets within the intake manifold 21. It should be noted that the desired results cannot be achieved by placing a screen or plural screens across the manifold opening 38 and it is essential that the movable screen assembly extend inside of the manifold 21 and be capable, because of its cylindrical shape, of aiming the atomized charge in all directions so that all of the engine cylinders can be equally supplied with the atomized charge through the manifold branches 22 and 23.

At its top, extending above the two screens 36 and 37, the rigid cage 32 has the previously-noted comparatively short sleeve bearing 39 fixed in its bore to guide the screen assembly smoothly on the fixed sleeve 29 and for maintaining a necessary radial spacing on the screens from the fixed sleeve 29 at all times. In the operation of the invention, this radial "jump space" for the fuel charge between the sleeve 29 and screens is necessary and critical, and if not maintained, complete atomization of the fuel charge will not be obtained. When the fuel charge exits the lower end of sleeve 29 and turns ninety degrees to the axis of sleeve 29 to pass radially in all directions through the exposed areas of screens 37 and 36, the charge will gain velocity and momentum across the jump space before impinging on the screens for atomization.

For further guidance of the screen assembly 31 during its movement and to prevent the fuel charge from reversing flow and passing upwardly between the exterior of fixed sleeve 29 and the screens, a second sleeve bearing 40 is fixed on the exterior of sleeve 29 at or slightly above its lower end in axially opposed relation to the upper sleeve bearing 39. The bearing 40 is in sliding contact with the interior stainless steel screen 37.

At the bottoms of the screen exposure slots 44, relatively minute engine idle notches 34' are formed through the rigid cage 32 to allow proper idling as when the screen assembly is in the relative retracted position indicated by the phantom line A in FIG. 7. This line A in FIG. 7 denotes the position of the bottom end of fixed sleeve 29 relative to the screen assembly when the screen assembly is at the engine idle position. The line A also denotes that the idle notches 34 will still be exposed or open and not blocked by the fixed sleeve 29 in the idle position. In a second relative position of the lower end of sleeve 29 to the movable screen assembly indicated by the phantom line B in FIG. 7, the sleeve 29 will cover the main slots 34 and idle notches 34' thus nearly completely blocking the fuel charge through the sleeve 29 from entering the intake manifold. This condition of the atomizing valve is also separately shown in FIG. 9 which is the condition indicated by the line B in FIG. 7. This condition, which will be further discussed, exists only during engine deceleration which induces maximum vacuum in the manifold 21. The cutting off of the fuel charge during deceleration prevents wasting fuel which is not needed for burning or for producing power at this time and also eliminates raw fuel exhaust emissions which are present in great quantities during deceleration under present day standard practice.

FIG. 7 also illustrates above the engine idle line A that the axially movable screen assembly 31 is automatically extended from the fixed sleeve 29 responsive to engine demand to whatever relative position is required to satisfy the demand for completely atomized fuel in the engine. The automatic adjustability or movement of the screen assembly is infinitely variable in the invention and constitutes one of the main features of the invention. When the accelerating engine demands or calls for more fuel, the resulting increase in velocity of the incoming fuel charge progressively opens or extends the screen assembly 31 to meet the demand by exposing progressively greater areas of screen through the slots 34 which are progressively uncovered by the fixed sleeve 29. In all conditions, the two screens effect complete fuel charge atomization.

It should also be stated that, when the fuel charge traveling downwardly from the fixed sleeve 29 impinges on the arched bottom wall 41 of the cage, such bottom wall will tend to deflect the charge radially in all directions through the atomizing screens and the charge will turn in its travel 90 degrees from the axis of the sleeve 29 so as to be aimed in the atomized state at the combustion chambers. While desirable, the arching of the bottom wall 41 is not essential to satisfactory operation of the invention. As previously noted, the atomizing valve 28 is spring-biased to the engine idle position A where only the idle notches 34 are open to the incoming charge. This spring-biasing means shown at 42 in the drawings forms a very important part of the invention. It not only enables the atomizing valve 28 to automatically open gradually inside of the manifold 21 as engine demand increases, but the biasing means is constructed to offer more resistance to valve opening during engine idle or at slow speeds than later on at higher speeds where engine demand increases. Under those conditions, the spring-biasing means offers less resistance to opening of the atomizing valve because of its unique geometry, to be described. The desired results and greatest engine efficiency could never be achieved with a constant tension spring-biasing means acting on the movable element of the atomizing valve.

The variable tension valve biasing means 42 for the valve 28 comprises a retractile spring 43 near one side of the element 26 having one end connected to a crank arm 44 through a link 45 pivoted at 46 to the crank arm. The crank arm 44 is pivoted between its ends to the element 26 through a rocker shaft 47. The crank arm 44 is biased toward engagement with an adjustable screw stop 48 on the element 26, as best shown in FIG. 2. The other end of spring 43 is secured to a threaded spring tension adjusting means 49.

Figure 4:
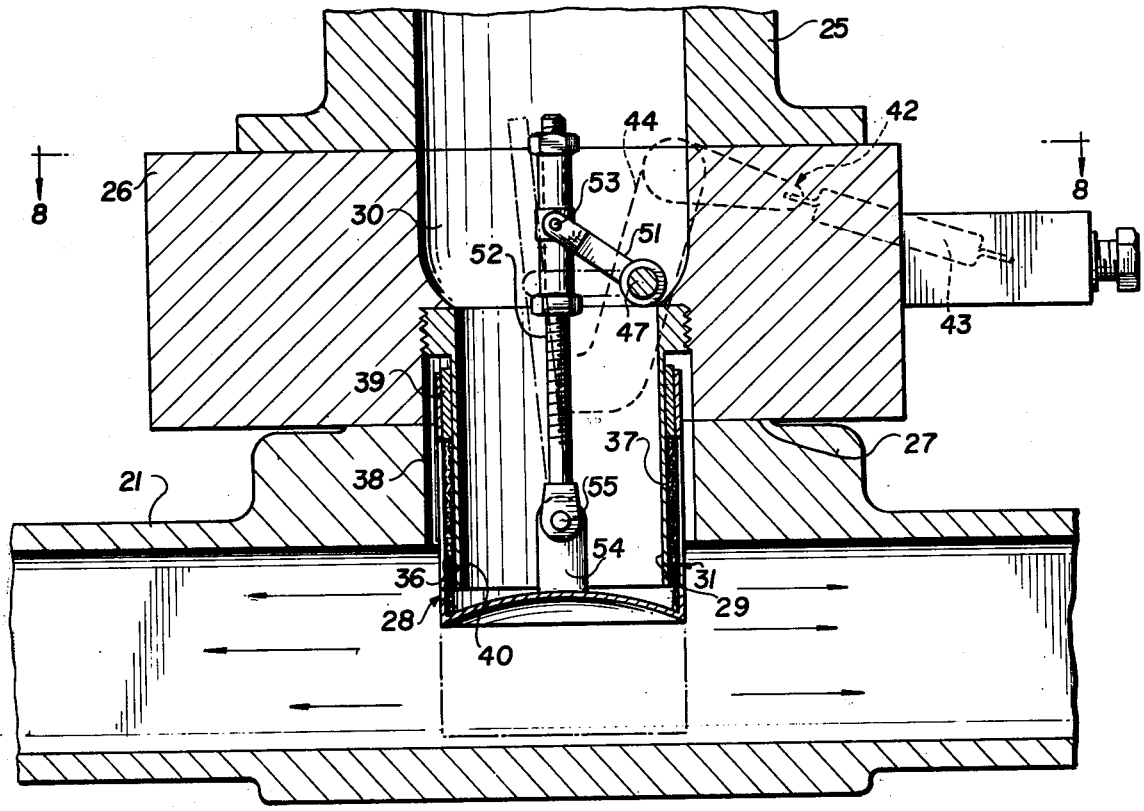
FIG. 4 is a central vertical cross section taken through the intake manifold, atomizing valve and support module.
Figure 6:
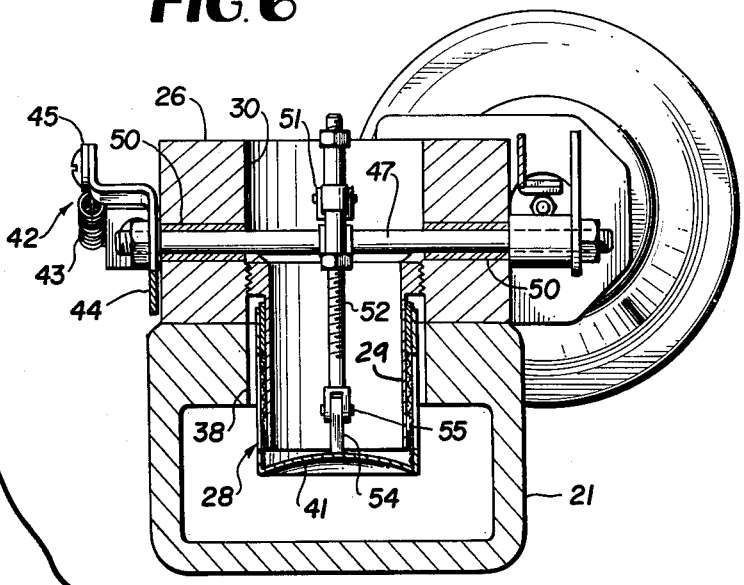
FIG. 6 is a vertical section through the valve and support element at right angles to FIG. 4.
Figure 8:
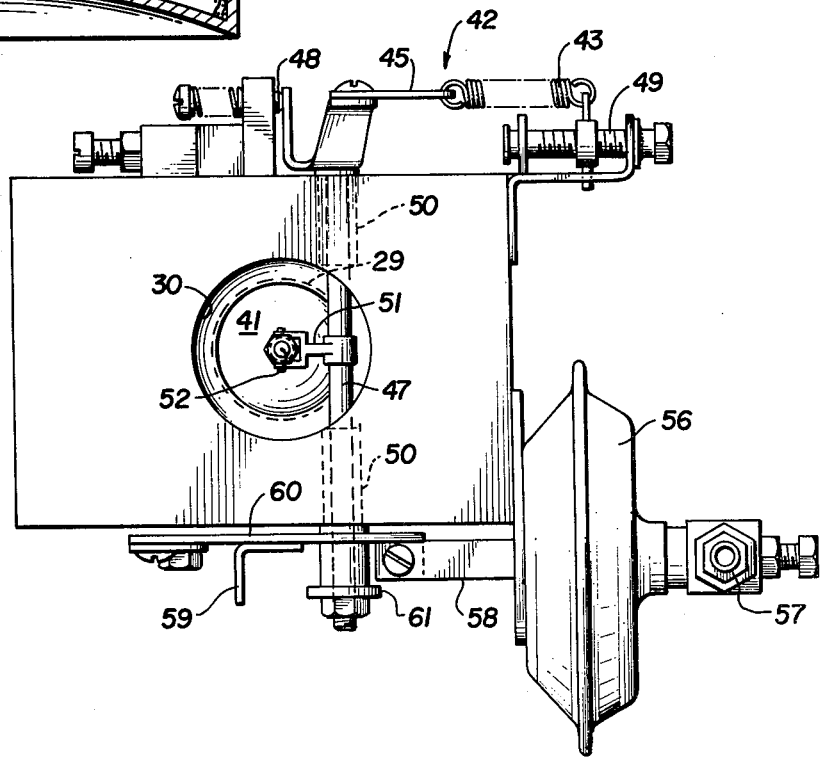
FIG. 8 is a plan view of the valve and associated elements taken substantially on line 8—8 of FIG. 4.

The rocker shaft 47 to which the crank arm 44 is firmly attached extends across the mounting module or element 26, FIGS. 4, 6 and 8, and is suitably journaled therein by bearing means 50. The rocker shaft 47 intersects the bore 30, FIG. 8, and its axis is offset substantially from the center axis of the bore 30 which bore is coaxial with the axis of the atomizing valve 28. The axis of rocker shaft 47 extends chord-wise of the bore 30, FIG. 8. A driving fork 51 is attached to the rocker shaft 47 rigidly to turn therewith, and is disposed bodily in the bore 30 above the fixed sleeve 29. The fork 51 straddles a connecting rod 52 and is pivoted thereto at 53 substantially above the valve 28. The connecting rod 52 extends to a location near and above the bottom wall 41 of the cage 32 and is pivoted to a central upstanding anchor 54 by means of a wrist pin 55, the anchor 54 being disposed centrally on the cage bottom wall 41. The driving fork 51, FIG. 4, swings through an arc and is centered on rocker shaft 47 and during such movement connecting rod 52 can pivot about the axis of the wrist pin 55 as shown in phantom lines in FIG. 4 so that the mechansim will not bind. A feature of the invention is that the connecting rod 52 forms the ultimate support for the cage 32 and screens. This is a simple and convenient arrangement. When the engine is shut off, the parts are adjusted so that the cage or screen assembly 31 will assume approximately the idle position A, FIG. 7.

Referring to FIG. 4, the over-dead-center relationship of the driving fork pin 53 to the axis of rocker shaft 47 can be noted. By virtue of this geometry, the biasing spring 43, through its linkage, offers greatest resistance to downward extension of the screen assembly 31 at idle speed and at relatively slow engine speed above idle. The resistance of the biasing means 42 gradually lessens in response to greater engine demand for fuel as engine speed increases and this lessening of spring resistance occurs as the driving fork 51 approaches dead-center relationship with the axis of rocker shaft 14 or beyond dead-center. Therefore, at the higher engine speeds where the demands for fuel is the greatest, and vacuum in the manifold 21 is decreased, the resistance offered by the spring-biasing means 42 will be less than at comparatively low speeds above idle or during idling. The described arrangement is critical for proper operation of the atomizing valve.

A further feature of the invention shown in FIG. 3 comes into play only during rapid engine deceleration to save fuel and to prevent polluting the atmosphere through the exhaust system. During deceleration, intake manifold vacuum peaks, and unless the supply of fuel is completely or very nearly shut off, great quantities of fuel will be sucked into the intake manifold and cylinders and wasted through the exhaust system and into the atmosphere in a largely unburned state, because the engine is not working during deceleration and no appreciable burning of fuel is taking place.

Figure 9:
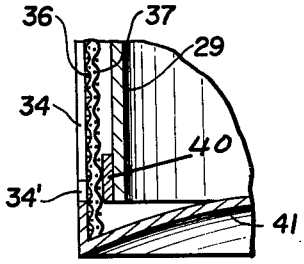
FIG. 9 is a fragmentary section, similar to FIG. 7, showing the valve screen assembly substantially entirely closed in relation to the sleeve.

To assure nearly complete closure of the valve screen assembly 31 to the position B, FIGS. 7 and 9, during deceleration, a vacuum booster 56 having a direct connection through a fitting 57 and associated hose with vacuum in the manifold 21 responds to such high vacuum by shifting a link 58 in one linear direction until a projecting lug 59 on an extension link 60 engages a crank arm 61 on the adjacent end of rocker shaft 47 or the end remote from the crank arm 44 of the spring-biasing means 42. The force of this engagement of the crank arm 61 through the vacuum booster 56 is sufficient to retract the screen assembly 31 to substantially closed position B, thus preventing the atomizing valve from opening during engine deceleration with the stated advantages. In actual manufactured form, the vacuum booster 56 and associated linkage may be eliminated and an equivalent means in the form of a servo-piston can be placed inside of the module 26 to provide the same function. Likewise, the mechanical configuration of biasing means 42 may be changed in production without altering the mode of operation.

Summary of Operation

Assuming that the engine 20 is idling, the following conditions will prevail. Carburetor 25 will supply a charge containing a proper ratio of air and fuel into the bore 30 and thence to the fixed sleeve 29 of the atomizing valve. The fuel itself possesses lubricating properties and detergents and this aids in making the valve operate freely as well as keeping it clean and unclogged.

During idling, the valve cage 32 is at position A, FIG. 7, with only small areas of the screens exposed at the notches 34', the main slots 34 being completely covered by the sleeve 29. A sufficient volume of the fuel charge to maintain idling will be completely atomized through the two screens 37 and 36 at the notches 34' and in flowing outwardly through these small notches the charge will attain a high velocity in all radial directions around the circumference of the cylindrical valve 28 within the manifold 21. Atomization will be just as complete as at higher engine speeds where there is greater opening of the valve 28 and correspondingly greater screen areas uncovered or exosed.

The fuel charge delivered to the manifold 21 in completely atomized form through the valve 28 is an ambient temperature charge using ambient air instead of a heated charge in accordance with present-day automotive practice under which the intake manifold is actually heated. In the invention, the fuel charge is 200° F.–400° F. cooler than under standard practice, thereby greatly increasing volumetric efficiency in accordance with one of the prime objectives of the invention. In this regard, the invention departs radically from the most recent prior art practices and a great deal of the success of the invention lies in the use of an ambient air temperature fuel charge in combination with the other enumerated main features.

The previously-described radial spacing afforded by bearings 39 and 40 causes the incoming fuel charge, after turning 90° from the axis of sleeve 29, to pass radially in all directions across the described jump space between the bore of the sleeve 29 and the screen 37 before striking the screens. In negotiating this radial jump space, the charge acquires the necessary velocity and momentum for complete atomization by the two screens at all engine speeds. Thus, a cool, dense and completely atomized charge which is uniform and has high velocity is delivered to the engine combustion chambers.

The resulting reduced time of combustion in the combustion chambers further reduces temperature and greatly impedes the formation of highly toxic nitric oxide ($NO_x$) which is formed only under very high temperatures. The absence of $NO_x$ is evidenced in engines equipped with the invention by the absence of a telltale white ash on the exhaust pipe. This is an important benefit achieved by the invention additional to its economy and performance benefits. The more complete combustion of the charge by means of the invention also substantially reduces carbon monoxide and unburned hydrocarbons in the exhaust emission. The more nearly complete combustion of fuel forms an exhaust containing greater amounts of carbon dioxide and water, which is desirable.

It should be stated that the described radial jump space between the screen 37 and the bore of sleeve 29 is in the dimensional range of 1/16 to ¼ inch, and preferably ⅛ inch. This feature combined with the variable tension spring-biasing means 42 and the arrangement of the two screens 36 and 37 in tight contact is the heart of the invention and critical to the important improved economy and engine performance achieved with the invention.

A final important feature or benefit of the invention is its harnessing and utilization of an inherently available energy source which heretofore has been overlooked in the art. This utilized source is the kinetic energy present in the air-fuel mixture stream entering the intake manifold from the carburetor. The invention utilizes the velocity of this always available stream to operate the movable screen assembly 31 of the atomizing valve against the spring-biasing means and no outside source of energy is required for this.

The many advantages of the invention should now be apparent to those skilled in the art without further explanation herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In an internal combustion engine having an intake manifold to receive a fuel charge from a carburetor for delivery through said manifold to engine cylinders, said manifold having a main inlet opening for the fuel charge, the improvement comprising a mounting element adapted for interposition between said manifold and said carburetor and having a bore in communication with said main inlet opening, a fixed sleeve on the mounting element depending therefrom and extending into the intake manifold through said main inlet opening, an atomizing screen assembly telescopically engaged with the fixed sleeve and being extensible and retractable relative thereto in said manifold, said screen assembly comprising a relatively rigid cage, first and second concentric screens fixed within the cage and being in circumferential contact, bearing means between the fixed sleeve and the screen assembly and maintaining a radial space around the fixed sleeve and between it and the innermost of said concentric screens, the innermost screen being relatively coarse mesh screen and the outermost screen being a finer mesh screen, and automatically variable resistance biasing means connected with the screen assembly and resiliently urging it toward a retracted position on the fixed sleeve and yielding in response to the increased demand of an engine for fuel and increasing engine speeds to allow automatic gradual extension of the screen assembly on the fixed sleeve to progressively uncover greater screen areas through open spaces of said cage relative to the fixed sleeve.

2. An automatically variable fuel charge atomizing valve for an engine having an intake manifold including a fuel charge inlet, said atomizing valve comprising mounting means having a fuel charge passage to communicate with said manifold fuel charge inlet, a fixed sleeve on the mounting means extending through said fuel charge inlet to the interior of the manifold, a reciprocable atomizing screen assembly on the fixed sleeve and adapted to project varying distances from the fixed sleeve into the manifold responsive to varying demands of an engine for fuel, radial spacing means between the fixed sleeve and reciprocable atomizing screen assembly, and an automatically varying spring tension biasing means connected with the screen assembly and urging it toward a retracted position on the fixed sleeve whereby the fixed sleeve covers substantially the interior of the screen assembly to block substantially the passage of a fuel charge therethrough radially inside of the manifold, and said biasing means including an over-dead-center linkage operable to cause the biasing means to most strongly resist extension of the screen assembly on the fixed sleeve at low engine speeds and to gradually decrease resistance to extension of the screen assembly on the fixed sleeve at higher engine speeds.

3. An automatically variable fuel charge atomizing valve as defined in claim 2, and said screen assembly comprising an interior relatively coarse mesh annular screen, an exterior relatively fine mesh annular screen, the two screens being concentric and being in firm contact entirely around their circumferences, and a substantially rigid cage containing and confining said screens, said cage comprising a plurality of bars intervened by slots through which the screens are progressively exposed as the screen assembly is extended axially on the fixed sleeve.

4. An automatically variable fuel charge atomizing valve as defined in claim 3, and the cage additionally having comparatively small engine idle notches formed through its side wall at the lower ends of said slots, the cage having a bottom wall and said screens extending from the bottom wall to a point somewhat beyond the far ends of the slots so as to cover completely said notches and slots.

5. An automatically variable fuel charge atomizing valve as defined in claim 2, and said radial spacing means comprising a first sleeve bearing fixed on the interior of the cage at the tops of said screens and having a bore in sliding engagement with the exterior of the fixed sleeve, and a second sleeve bearing on the exterior of the fixed sleeve near the lower end of the fixed sleeve in axially opposing relationship to the first sleeve bearing and being in sliding engagement with the interior screen.

6. An automatically variable fuel charge atomizing valve as defined in claim 3, and the interior screen being a 30–60 mesh stainless steel screen, the exterior screen being a 100–250 mesh stainless steel screen.

7. An automatically variable fuel charge atomizing valve is defined in claim 2, and additional means connected with said screen assembly and responding to high vacuum in the intake manifold caused by engine deceleration and then forcing the screen assembly to a substantially fully retracted and closed position on the fixed sleeve to substantially block the admission of the fuel charge through the atomizing valve to the intake manifold.

8. An automatically variable fuel charge atomizing valve as defined in claim 7, and said additional means including a vacuum booster device having a connection into the intake manifold, and an override linkage operated by said device and having a connection with said biasing means, whereby the screen assembly can be driven to said substantially fully retracted and closed position.

9. An automatically variable fuel charge atomizing valve as defined in claim 2, wherein said over-dead-center linkage comprises a rocker shaft on said mounting means, an eccentric drive element secured to the rocker shaft within said fuel charge passage, a connecting rod having one end pivoted to said reciprocable screen assembly, and said connecting rod having a pivotal connection with said eccentric drive element in an over-dead-center relationship to the axis of the rocker shaft, said connecting rod extending across the axis of the rocker shaft, and an adjustable tension spring and a spring-connected crank arm connected with said rocker shaft.

10. An automatically variable fuel charge atomizing valve as defined in claim 9, and said screen assembly including an exterior cup-like cage having an end wall, and said connecting rod being pivotally coupled through a wrist pin means with said end wall.

11. An automatically variable fuel charge atomizing valve device for engines comprising a mounting element having a passage, a fixed sleeve secured to the mounting element within said passage and extending beyond one face of the mounting element for entry into an intake manifold, a substantially cylindrical atomizing screen assembly mounted for extension and retraction on said fixed sleeve and adapted to extend varying distances into the manifold across the major axis of the manifold with the fixed sleeve covering and uncovering varying screen areas of said screen assembly, bearing spacer means between the fixed sleeve and screen assembly and establishing a radial space of predetermined magnitude between the bore of the fixed sleeve and the interior of the screen assembly, and a variable tension over-dead-center biasing linkage connected with said screen assembly and resisting extension of the screen assembly on the fixed sleeve with progressively decreasing biasing force as said screen assembly is extended automatically in response to increasing engine demand for fuel.

12. In an internal combustion engine having an intake manifold and a down draft carburetor for delivering a fuel charge into said manifold, the improvement comprising an automatically variable atomizing valve unit including a mounting element arranged between the manifold and carburetor, a fixed sleeve on the mounting element extending inside of said manifold, a relatively movable atomizing screen assembly on the fixed sleeve and adapted to have its atomizing screen side wall progressively uncovered by the fixed sleeve during automatic movement progressively of the screen assembly into the manifold responsive to increasing engine demand for fuel, and automatically varying and gradually decreasing resistance biasing means interconnecting said mounting element and said screen assembly.

* * * * *